US008353535B2

(12) United States Patent
Salmon et al.

(10) Patent No.: US 8,353,535 B2
(45) Date of Patent: Jan. 15, 2013

(54) SKATE WITH PIVOTING ROCKER AND REPLACEABLE BLADE

(75) Inventors: John Jasper Salmon, North York (CA); Richard Charles Hampton, King City (CA)

(73) Assignee: Multimatic Inc., Markham (CA)

( * ) Notice: Subject to any disclaimer, the term of this patent is extended or adjusted under 35 U.S.C. 154(b) by 470 days.

(21) Appl. No.: 12/523,424

(22) PCT Filed: Jan. 18, 2008

(86) PCT No.: PCT/CA2008/000099

§ 371 (c)(1), (2), (4) Date: Jul. 16, 2009

(87) PCT Pub. No.: WO2008/086620

PCT Pub. Date: Jul. 24, 2008

(65) Prior Publication Data

US 2010/0109312 A1 May 6, 2010

(30) Foreign Application Priority Data

Jan. 19, 2007 (CA) ..... 2574753
Aug. 8, 2007 (CA) ..... 2596524

(51) Int. Cl.
*A63C 1/00* (2006.01)

(52) U.S. Cl. ..... 280/841; 280/7.13; 280/7.14; 280/600

(58) Field of Classification Search ..... 280/11.12, 280/11.18, 11.17, 841, 28, 609, 610, 7.13, 280/7.14

See application file for complete search history.

(56) References Cited

U.S. PATENT DOCUMENTS

| | | | | |
|---|---|---|---|---|
| 2,108,128 | A * | 2/1938 | Kinney | 280/11.18 |
| 3,947,050 | A | 3/1976 | Isely | |
| 5,088,749 | A * | 2/1992 | Olivieri | 280/11.18 |
| 5,123,664 | A | 6/1992 | DeMars | |
| 5,332,242 | A * | 7/1994 | Cann et al. | 280/11.18 |
| 5,383,674 | A | 1/1995 | Cann et al. | |
| 5,641,169 | A | 6/1997 | Bekessy | |
| 5,769,434 | A * | 6/1998 | Wurthner | 280/11.18 |

(Continued)

FOREIGN PATENT DOCUMENTS

CA 2145520 C 4/1994

(Continued)

OTHER PUBLICATIONS

"PCT International Search Report dated Apr. 22, 2008 for PCT/CA2008/000099, from which the instant application is based," 3 pgs.

*Primary Examiner* — Hau Phan
(74) *Attorney, Agent, or Firm* — Fredrikson & Byron, PA

(57) ABSTRACT

A replaceable blade ice skate (9) comprising a holder (2), a blade system having at least one blade engagement portion (11) and a blade (4, 52), at least one attachment device (5) mounted to the holder for movement between a blade securing position and a blade releasing position. The attachment device having an attachment engagement portion (6), wherein the blade system is retained in the holder via the blade engagement portion detachably mating with the attachment engagement portion when the attachment device is in the blade securing position. The blade system further comprising a downward facing rocker (3) and a flexible replaceable blade (4) which conforms to the first defined curvature of the rocker when mounted thereon.

25 Claims, 7 Drawing Sheets

U.S. PATENT DOCUMENTS 5,988,683 A * 11/1999 Venier et al. ..... 280/841
6,467,778 B1 * 10/2002 Goldsmith et al. ..... 280/11.12
6,695,322 B2 * 2/2004 Goldsmith et al. ..... 280/11.12
6,761,363 B2 * 7/2004 Fask et al. ..... 280/11.18
7,673,884 B2 * 3/2010 Wuerthner ..... 280/11.18
7,758,053 B2 * 7/2010 Wylie et al. ..... 280/11.12

FOREIGN PATENT DOCUMENTS

CA 2545970 A1 10/2005
DE 724488 A 8/1942

* cited by examiner

SKATE WITH PIVOTING ROCKER AND REPLACEABLE BLADE

BACKGROUND

This application is a 35 U.S.C.§371 national stage filing from International Application No. PCT/CA2008/000099, filed Jan. 18, 2008, which claims priority to Canadian Patent Application Nos. 2596524, filed Aug. 8, 2007, and 2574753, filed Jan. 19, 2007, the teachings of which are incorporated herein by reference.

Ice skates have been used for recreational and transportation purposes for hundreds of years. Originally, some sort of low friction sliding device akin to a metal blade was attached using straps to a conventional boot. Eventually, in the past century, boots specifically intended for use only in ice skating evolved, typically with the blade firmly affixed to the boot. The unitary blade and boot had the advantage of rigidity allowing more speed and control than previously possible.

For many years, it has been realized that there may be an advantage to providing a replaceable sharpened blade for ice skates. With heavy use, typically a conventional skate blade will wear out before the boot portion. Accordingly, there is an advantage to extending the life of the skate by replacing the blade rather than replacing the entire skate.

For advanced skaters particularly, the degree of curvature of the blade (referred to as "rocker" in the industry) is important. Different skaters will choose different rocker curvatures depending upon their personal preferences. Unfortunately, with conventional skate construction, manual sharpening of the skates in which the blade and rocker are synonymous tends to vary the rocker curvature slightly. Over the course of the lifetime of a conventional skate, this curvature can vary dramatically.

In addition, sharpening must normally be done by someone other than the skater using special grinding equipment. This is often inconvenient to the skater and involves a certain expense.

Certain of the prior art attempts to provide replaceable skate blades have involved replacement of a relatively heavy, and thus expensive, metal portion of the skate with substantial removal and fastening difficulties. Some such replaceable blades were intended to be sharpened a number of times before replacement. See, for example U.S. Pat. No. 5,088,749 to Olivieri. In other prior art attempts, the replaceable blade, although lightweight, has not been effectively mounted on the rocker to provide the security required particularly by advanced skaters. See, for example, U.S. Pat. No. 2,108,128 to Kinney. Still other replacement blades have been of a complex construction not easily adapted to inexpensive commercial production. See, for example, German Patent No. 724488 to Dornseif and U.S. Pat. No. 3,947,050 to Isely. Moreover, replaceable blades have tended to be prone to breakage owing to the structure of the blade and the tension under which the blade is placed in order to stretch it along the base of a skate blade. See, for example, U.S. Pat. No. 5,383,674 to Cann, et al.

U.S. Pat. No. 5,988,683 to Venier et al. describes a replaceable blade system in which the shortcomings of the prior art, including the excess breakage associated with the Cann patent configuration, has been solved using a novel means to connect the flexible replaceable blade to the skate so that it is pulled more or less longitudinally and tensioned evenly along its length. A torque limiting device provides for easy replacement and adjustment of blades by consumers without damage to the skate or the replaceable blade. A limitation of this arrangement is that the associated attachment and tensioning mechanism is complex and requires a separate torque limiting tool to operate. An additional problem of the Venier patent is that the tensioning mechanism requires a high stiffness and high strength rigid holder for mounting.

The present invention solves these prior art problems. The skate of the present invention utilizes an identical flexible replaceable blade configuration to the prior art patent of Venier. This blade is inexpensive, light and easily changed and can be replaced with little or no wear on the remainder of the skate. A result of this construction is that the blade is evenly tensioned along its length and the rocker curvature will not vary since no manual sharpening is required. In addition, different rocker curvatures can be chosen according to the user's preference and the identical replaceable blade can be used with all such rocker curvatures. The configuration of the present invention differs from the Venier prior art in that a pivoting rocker section is utilized to connect the blade to the skate. This pivoting rocker section utilizes differential radiuses to tension the blade once it has been retained rather than the tensioning bolt, tension plate and torque limiting mechanism of the Venier patent.

A simple retention latch is configured to retain the pivoting rocker section in a closed position with the flexible replaceable blade held in tension. The retention latch can be simply operated by a skater to release the pivoting rocker section to a released position for blade replacement. This system is superior to the Venier arrangement in that it does not require a separate tool to operate, the tensioning loads are contained within the rocker so the holder can be constructed from regular plastic materials and the number of parts and complexity are significantly reduced. Additionally the cross-sectional shape of the rocker of the present invention is significantly simpler than that of the Venier configuration allowing for the use of lower cost manufacturing techniques.

Another advantage of the present invention is that the retention system of the flexible replaceable blade configuration can also be utilized for a single piece solid blade system. The single piece blade system incorporates a blade along its lower surface. The solid blade arrangement can be sharpened in a conventional manner as well as removed and replaced so as to extend the overall life of the ice skate assembly.

SUMMARY OF THE INVENTION

Accordingly, the ice skate of the present invention comprises a holder; a blade system with a lower surface of a first defined curvature and at least one blade engagement portion; the blade system comprising a blade along the lower surface; at least one attachment device mounted to the holder for movement between a blade securing position and a blade releasing position; the attachment device having an attachment engagement portion; wherein the blade system is retained in the holder via the blade engagement portion detachably mating with the attachment engagement portion when the attachment device is in the blade securing position.

In an aspect of the invention, the blade is integral with the blade system.

In a further aspect of the invention, the blade system comprises a downward facing rocker with a lower surface of the first defined curvature, a front end a rear end; a flexible replaceable blade having a second curvature when not attached to the rocker; the flexible replaceable blade having an upper surface, a lower ice-contacting surface, a front end and a rear end and being adapted to be removably mounted to the rocker; front securing means for attaching the front end of the flexible replaceable blade to the front end of the rocker; rear securing means for attaching the rear end of the flexible replaceable blade to the rear end of the rocker; wherein the flexible replaceable blade conforms to the first defined curvature of the rocker when mounted thereon. In this way a skater can easily release a used flexible replaceable blade from the rocker and simply change it for a new replaceable blade. The flexible replaceable blade curvature will then conform to the first defined curvature of the downward facing rocker.

In an aspect of the invention the flexible replaceable blade is formed with a groove along the length of its upper surface that mates with a corresponding ridge or tongue along the lower surface of downward facing rocker.

In a preferred embodiment of the invention, the rear end of the downward facing rocker is adapted to rotate between an open position and a closed position, around a pivot point fixed to the front end of the rocker such that the rotation of the rear end of the rocker portion into the closed position creates a tension along the length of the flexible replaceable blade.

In an aspect of the preferred embodiment of the invention, the attachment engagement portion of the attachment device detachably mates with the blade engagement portion so as to retain the rotatable rear end of the rocker in the closed position when the attachment device is in the blade securing position.

In a further aspect of the invention, the attachment device includes at least one biasing device, preferably a spring, that biases the attachment device to the blade securing position and the attachment device also incorporates a releasing feature, preferably a button that is adapted to move the attachment device between the blade securing position and the blade releasing position.

In a further aspect of the invention the attachment device is a retention latch, the attachment engagement portion is a pawl feature and the blade engagement portion comprises a striker feature.

In another aspect of the invention, the flexible replaceable blade is capable of being mounted on a rocker having any of a variety of first curvatures.

In a further aspect of the invention, the flexible replaceable blade is curved more than 90° at both the front end and the rear end thereof for placement and attachment into the front and rear securing means.

In another preferred embodiment of the invention, the holder has at least one substantially enclosed chamber; at least one attachment device is mounted and substantially located in the chamber of the holder for movement between a blade securing position and a blade releasing position; the attachment device having an attachment engagement portion accessible through a first opening to the chamber and at least one button which is accessible through a second opening to the chamber to move the attachment device between the blade securing position and the blade releasing position; wherein a blade system is retained in the holder via the blade engagement portion detachably mating with the attachment engagement portion when extended through the first opening in the holder and when the attachment device is in the blade securing position.

In an alternative embodiment of the invention, the holder has another attachment device with another attachment engagement portion and the blade system has another blade engagement portion that detachably mates with the another attachment engagement portion.

In a further preferred embodiment of the invention, the holder has a compliant retention surface and an integrated retention pin; the blade system has a lower surface of a first defined curvature, a biasing surface, a front retention hook and a striker feature; the blade system comprising a blade along the lower surface; a retention latch is pivotally mounted to the holder for movement between a blade securing position and a blade releasing position; the retention latch has a pawl feature and a button to move the retention latch between the blade securing position and the blade releasing position and a spring that biases the retention latch to the blade securing position; wherein said blade system is retained in the holder via the front retention hook being biased into cooperation with the integrated retention pin by interaction of the biasing surface and compliant retention surface, and the striker feature detachably mating with the pawl feature when the retention latch is in the blade securing position, such that the blade system can also be easily detached from the holder by operation of the button feature by a skater so that the retention latch is moved from the blade securing position to the blade releasing position.

Further aspects of the invention will become apparent from the following description.

DETAILED DESCRIPTION OF THE INVENTION

Figure 1:
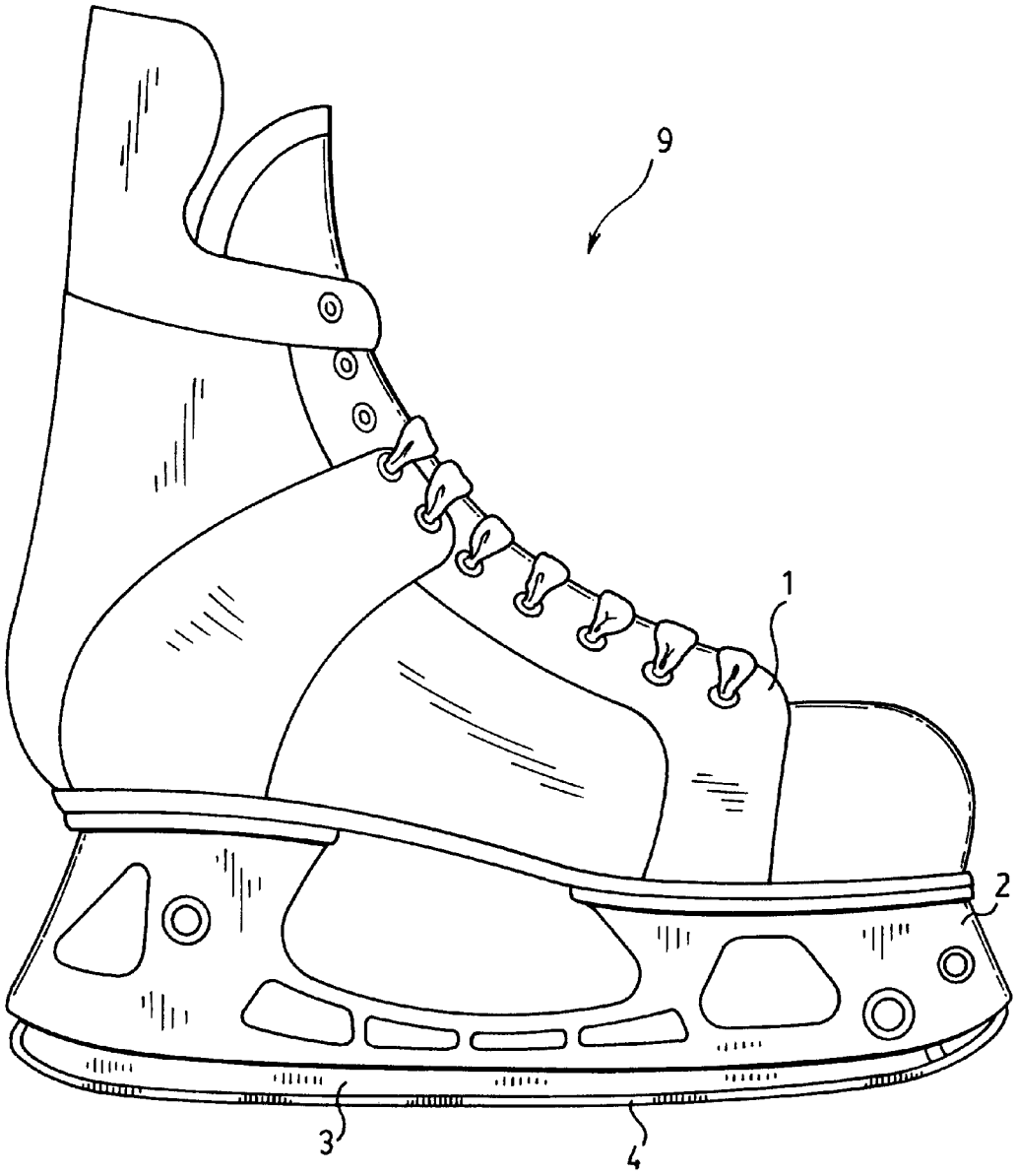
FIG. 1 is a side view of the replaceable blade ice skate assembly.
Figure 4:
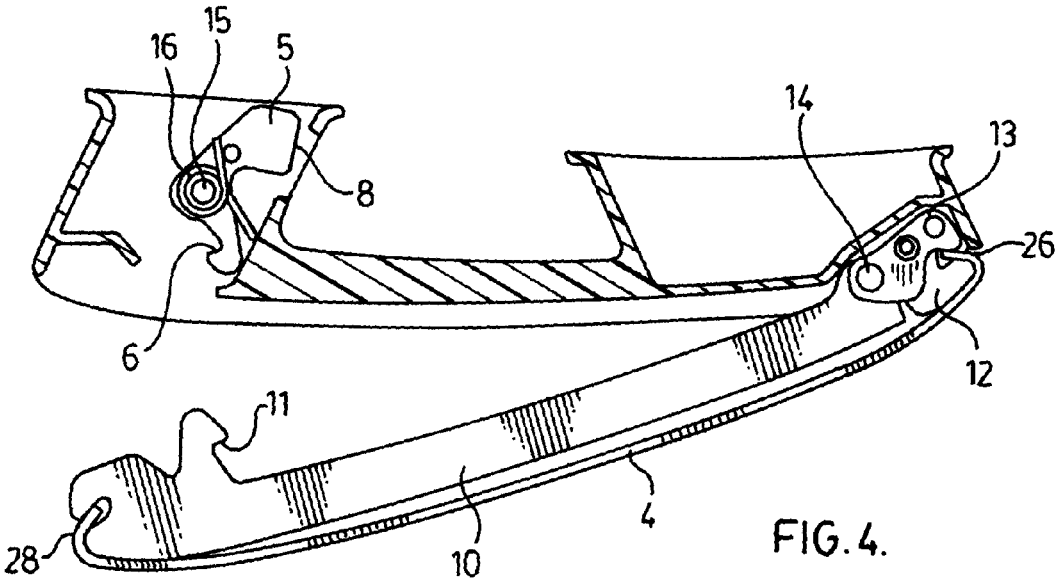
FIG. 4 is a schematic view of a section through the holder, rocker, blade and attachment means shown in the released position.
Figure 5:
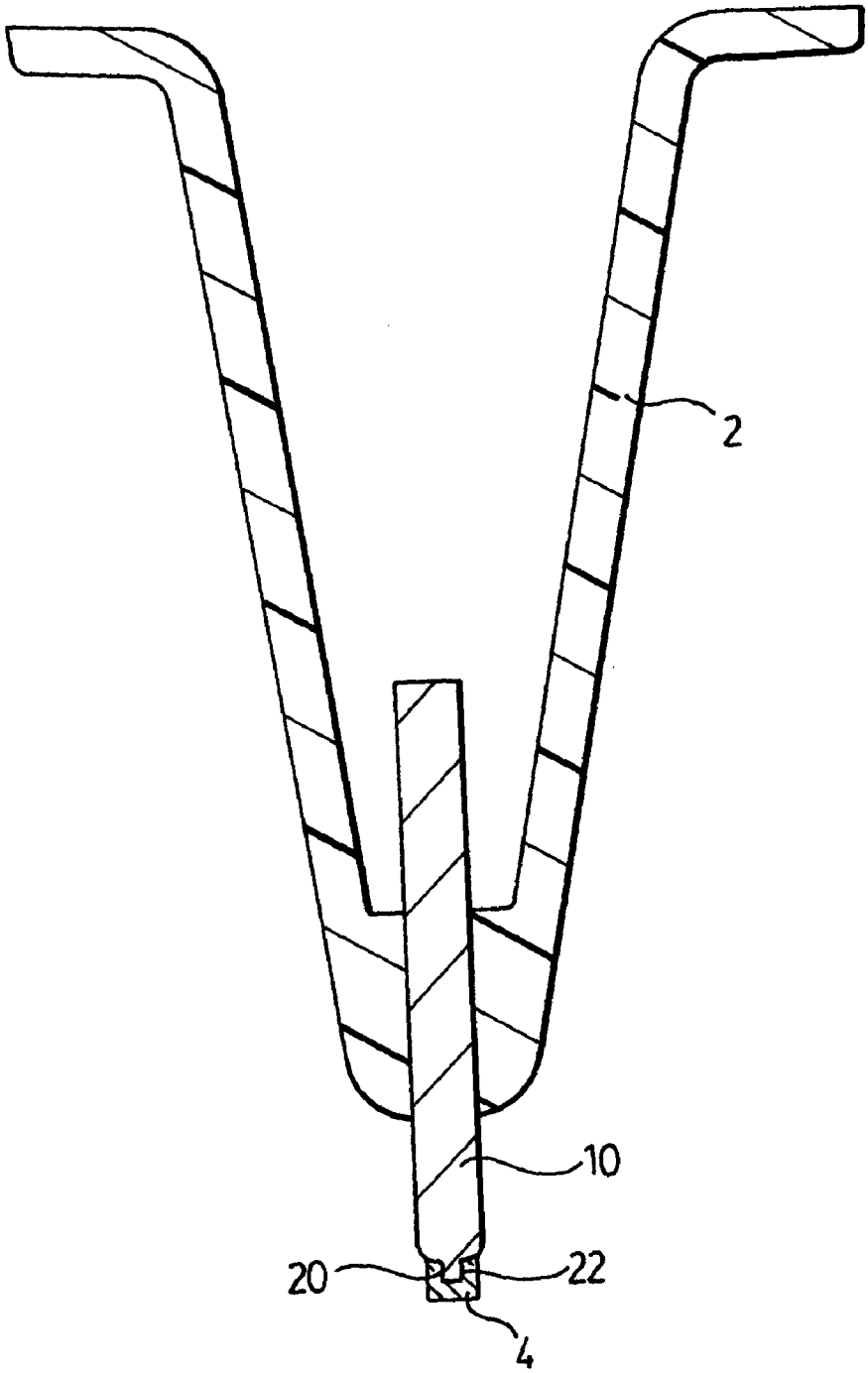
FIG. 5 is a cross sectional view through the holder, rocker and blade shown in the closed position.

Referring to FIG. 1, a replaceable blade ice skate assembly (9) is substantially constructed from a boot (1), a holder (2) adapted to be mounted to the boot, a downward facing rocker (3) and a flexible replaceable blade (4). FIGS. 2, 3, 4 and 8 illustrate that the downward facing rocker (3) is configured with a first defined curvature and incorporates a front end (12), a pair of rocker attachment brackets (13) and a rear end (10). The rocker front end (12) is adapted to be immovably attached to the holder (2) via riveting, bolting or similar fastening means and is configured with ridge or tongue (20) and a toe receiving area (26). A pair of rocker attachment brackets (13) are immovably attached to both the holder (2) and the rocker front end (12) via riveting, bolting, welding, bonding, material upsetting or similar means. The rocker attachment brackets (13) are configured with a pivot joint (14) which is adapted to align with an appropriate clearance hole configured in the holder (2). The rocker rear end (10) is adapted to be rotatably attached to the rocker attachment brackets at the pivot joint (14) via a bushing and rivet or similar means. The rocker rear end (10) is configured with a blade engagement portion (11), heel receiving area (28) and ridge or tongue (20). An attachment device (5) is adapted to be pivotally mounted to the holder (2) at a latch pivot point (15). The attachment device (5) is configured with a releasing feature (8) and an attachment engagement portion (6). The attachment engagement portion (6) is configured to interlock with the blade engagement portion (11) so as to rigidly restrain the rocker portion rear end (10) in a closed position. FIG. 5 is a cross section of the rocker portion rear end (10) in the closed position illustrating that the flexible replaceable blade (4) includes a mating groove (22) adapted to snugly fit over the ridge or tongue (20).

Figure 6:
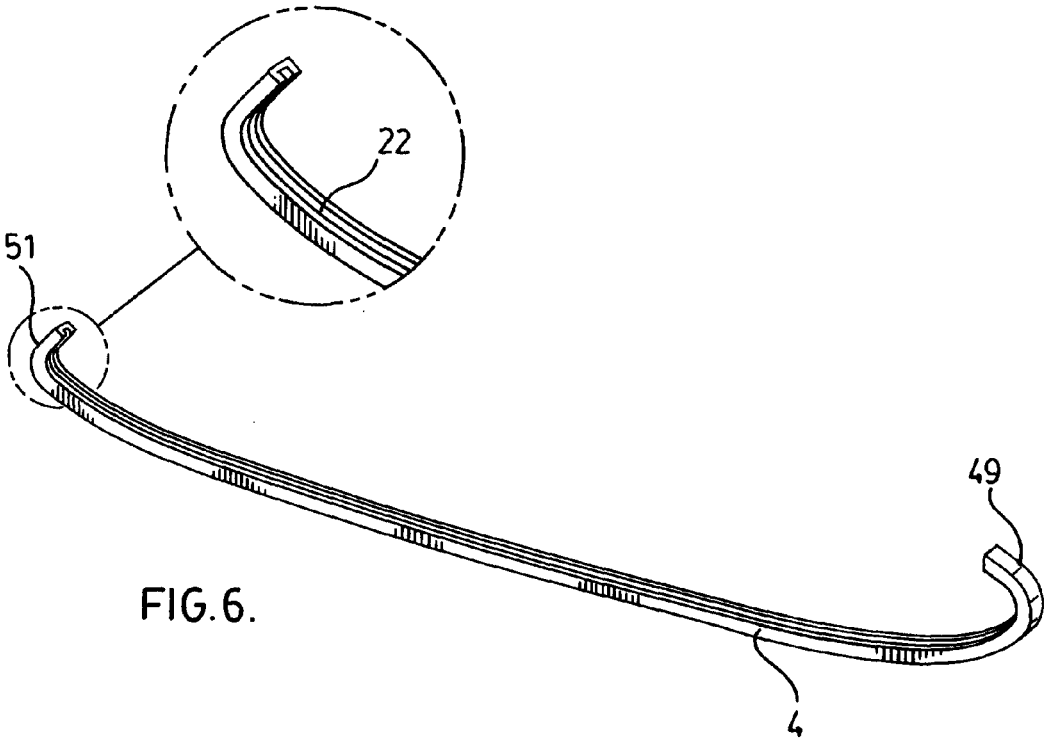
FIG. 6 is a perspective view of the flexible replaceable blade.

Referring to FIG. 6, the flexible replaceable blade (4) is configured with a second defined curvature and incorporates a front hook (49), a rear hook (51) and a groove (22) running along its entire length. The flexible replaceable blade (4) may be comprised of heat treatable steel which can be through hardened to Rockwell "C" scale 48 or greater. Hardenable varieties of stainless steel may be used to provide corrosion resistance. In the alternative, less expensive non-stainless, hardenable, drawable steel which has moderate to low corrosive resistance, may be employed; minor corrosion will generally not be a significant problem given that the blades are disposable and are not intended for long-term use.

The flexible replaceable blade (4) may be made using wire stock. The material for the blades arrives at the drawing/rolling facility in coils of round wire. It is then drawn through wire drawing dies and/or rolled into the desired cross-sectional shape, still in wire form. Following the drawing/rolling process, the material is then sharpened on the lower ice-contacting surface of the blade. Sharpening is typically performed using a grinding operation. The blade is then passed through spring wire bending machines to obtain the proper blade curvature and a defined bend or curvature is imparted to it using computer controlled, or conventional, spring bending machines. As previously stated a blade of a standard curvature may be fitted into rockers of many different curvatures. Such standardized replacement blades are a significant advantage.

The downwardly facing rocker portion (3) is typically constructed from an aluminum alloy but could also be made from steel or a similar metallic material. The rocker portion rear end (10) and the bushing and rivet arrangement at the pivot joint (14) are configured so that the rocker portion rear end (10) can be removed and replaced with those of different first defined curvatures. The holder is typically manufactured from a moulded plastic such as Nylon.

In a preferred embodiment of the invention the blade engagement portion (11) comprises a striker feature, the attachment device (5) is a retention latch adapted to be pivotally mounted to the holder (2) at a latch pivot point (15) and the retention latch (5) is configured with a releasing feature (8), preferably a button, and an attachment engagement portion (6) comprising a pawl feature. The pawl feature (6) is configured to interlock with the striker feature (11) so as to rigidly restrain the rocker portion rear end (10) in a closed position.

Figure 2:
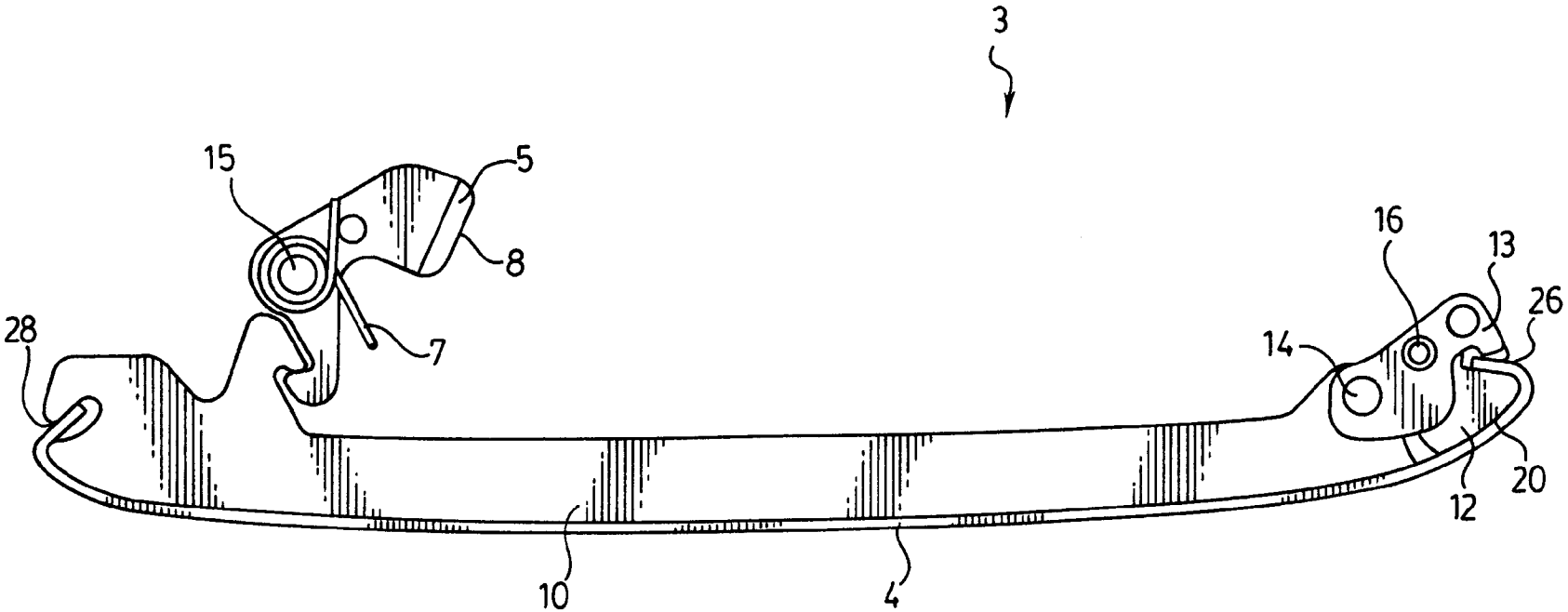
FIG. 2 is a schematic view of the rocker, blade and attachment means shown in the closed position.
Figure 3:
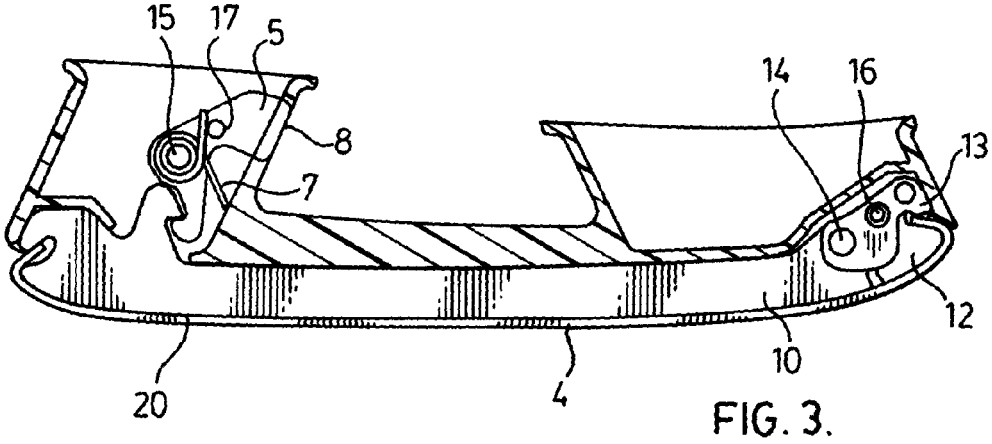
FIG. 3 is a schematic view of a section through the holder, rocker, blade and attachment means shown in the closed position.
Figure 7:
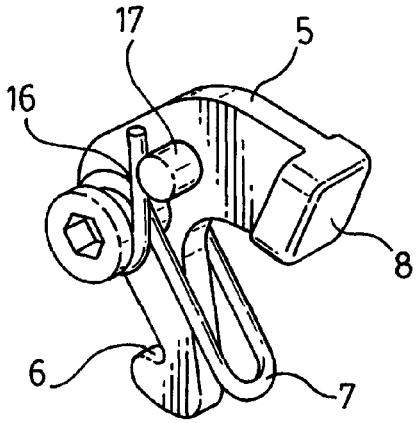
FIG. 7 is a perspective view of the retention latch.
Figure 8:
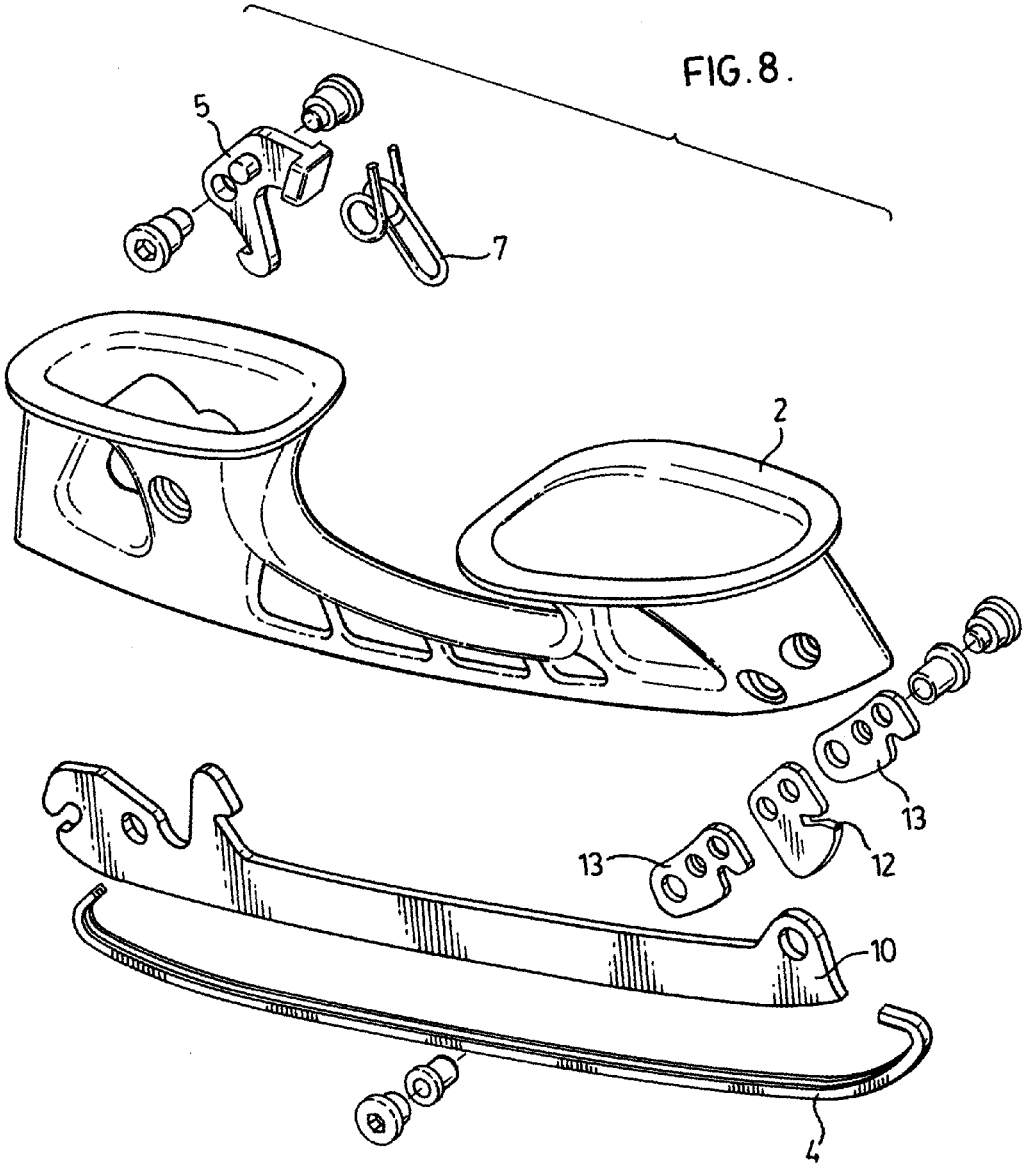
FIG. 8 is an exploded perspective view of the replaceable blade ice skate assembly.

FIG. 7 illustrates the retention latch (5) that would be typically manufactured from moulded plastic such as Nylon. The retention latch is configured with a pawl feature (6), button (8), a pivot hole (16) and a spring retention peg (17). A biasing device, preferably a spring (7) that would be typically manufactured from steel wire, is configured so as to impart a torque via the retention peg (17) so as to bias the pawl feature (6) into contact with the striker feature (11) of the rocker portion rear end (10) as illustrated in FIG. 2. When a skater imparts an operating force on the button (8) the spring torque is overcome and the pawl feature (6) is released from the striker feature (11) allowing the rocker portion rear end (10) to rotate from the closed to the released position as illustrated in FIG. 4.

The process of attachment of the blade to the rocker will now be described in further detail. The rocker portion rear end (10) is placed in its released position as illustrated in FIG. 4. The front hook (49) of the flexible replaceable blade (4) is hooked into the toe receiving area (26). Next, the rear hook (51) of the flexible replaceable blade (4) is hooked into the heel receiving area (28). The rocker portion rear end (10) is then rotated around the pivot joint (14) towards the closed position. As the rocker portion rear end (10) rotates, the heel receiving area (28) moves rearward relative to the toe receiving area (26) due to the radius defined by the pivot joint (14) being shorter than that defined by the overall flexible replaceable blade (4) length. The rearward movement of the heel receiving area (28) causes the flexible replaceable blade (4) to be tensioned substantially along its longitudinal axis. This helps to prevent the blade from breaking owing to excessive bending stress which can occur if the blade is tensioned around a corner or small radius (as would occur in certain prior devices). As the flexible replaceable blade (4) is tensioned and pulled onto the downwardly facing rocker portion (3), its curvature conforms to the first defined curvature of the downwardly facing rocker portion (3) and the upward facing groove (22) is engaged into, or fitted over, the ridge or tongue (20). When the rocker portion rear end (10) reaches the closed position, the pawl feature (6) of the retention latch (5) is biased into engagement with the striker feature (11) by the latch spring (7) so that the rocker portion rear end (10) is rigidly restrained in position.

Figure 9:
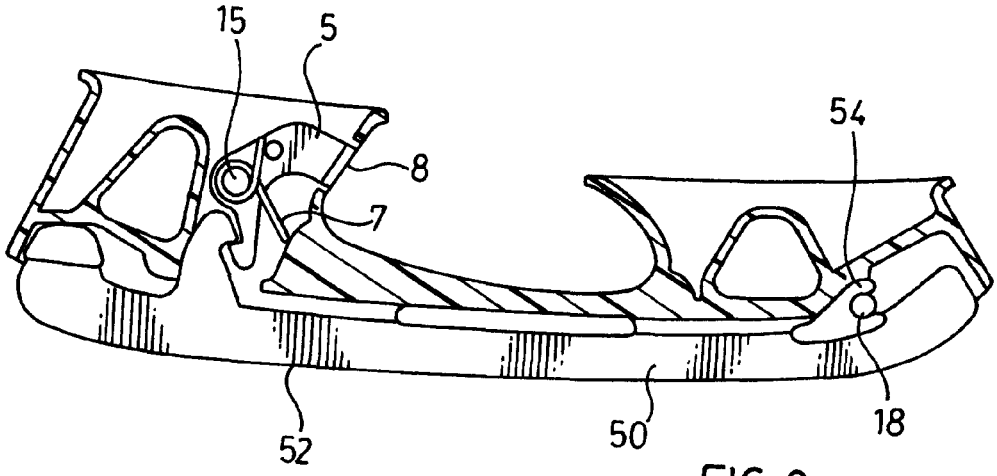
FIG. 9 is a schematic view of an alternative embodiment of the ice skate assembly holder, rocker and attachment means shown in the closed position.
Figure 10:
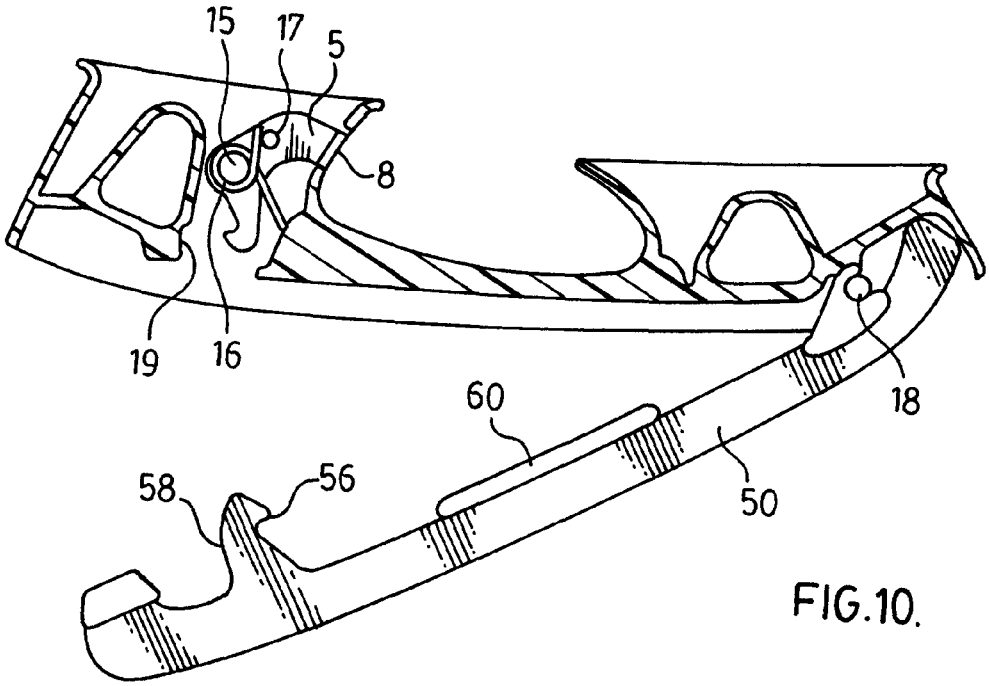
FIG. 10 is a schematic view of an alternative embodiment of the ice skate assembly holder, rocker and attachment means shown in the released position.

An additional preferred embodiment of the present invention is illustrated in FIGS. 9 and 10. This embodiment involves the usage of a single piece, downward facing blade system which integrally incorporates a blade and is attached to the holder (2) via the previously described flexible replaceable blade (4) retention system. This configuration is substantially constructed from a boot (1), a holder (2) adapted to be mounted to the boot and a blade system (50). The holder (2) is configured with a latch pivot point (15), a retention pin (18) in the same location as the previously described pivot joint (14), and a compliant retention surface (19). The blade system (50) may be comprised of heat treatable steel which can be through hardened to Rockwell "C" scale 48 or greater. Hardenable varieties of stainless steel may be used to provide corrosion resistance. The blade system (50) is configured with a lower surface of a first defined curvature and incorporates a blade (52) along the lower surface, a front retention hook (54), a striker feature (56), a biasing surface (58) and width compensators (60). A retention latch (5) identical to the previously described embodiment is configured with a button (8), a pawl feature (6), a pivot hole (16) and a spring retention pin (17). The blade system (50) is adapted to be retained in the holder via the front retention hook (54) interlocking with the retention pin (18) and the retention latch pawl feature (6) interlocking with the striker (56) as in the previously described embodiment.

When the blade system (50) is in the latched position, the biasing surface (58) interacts with the retention surface (19) of the holder (2) which biases the front retention hook (54) onto the retention pin (18). Owing to the different width requirements of steel blade systems and aluminum downward facing rocker portions, a width compensator (60) may be incorporated into the steel blade system (50) so that it may be utilized in the previously described holder (2) if it has been configured to accept a wider aluminum downward facing rocker portion (3). In this way, a common boot (1), holder (2)

and retention system can be utilized for a flexible replaceable blade (4) or a more conventional solid blade arrangement. The solid blade arrangement has the advantage that the blade system (50) can be sharpened in a conventional manner as well as removed and replaced so as to extend the life of the ice skate assembly. Additionally, the interaction of the biasing surface (58) with the compliant retention surface (19) imparts a residual compressive loading that eliminates all movement between the holder (2) and the blade system (50).

The foregoing description is intended to be illustrative of preferred embodiments of the invention. Variations of the construction described will be obvious to those skilled in the art and are intended to be covered by this invention.

The invention claimed is:

1. An ice skate comprising:

a) a holder;

b) the holder having an integral, downward facing rocker with a lower surface of a first defined curvature;

c) the downward facing rocker having a fixed front end and rear end adapted to rotate between an open position and a closed position;

d) a flexible replaceable blade having a second curvature when not attached to the rocker;

e) the flexible replaceable blade having an upper surface, a lower ice-contacting surface, a front end and a rear end and being adapted to be removably mounted to the rocker;

f) front securing means for attaching the front end of the flexible replaceable blade to the fixed front end of the rocker;

g) rear securing means for attaching the rear end of the flexible replaceable blade to the rotatable rear end of the rocker;

h) a retention latch adapted to be pivotally mounted to the holder and configured with a pawl feature;

wherein rotation of the rear end of the rocker between an open position and a closed position creates a tension along a length of the flexible replaceable blade without exerting a major component of tensioning force around a small radius in the region of the front and rear securing means and wherein the flexible replaceable blade conforms to the curvature of the lower surface of the rocker when mounted thereon, and the pawl feature of the retention latch retains the rotatable rear end of the rocker in the closed position.

2. An ice skate as defined in claim 1, wherein the pawl feature of the retention latch is biased via a spring into contact with a striker feature incorporated in the rear end of the rocker so that the rear end of the rocker is positively retained in the closed position, and the retention latch also incorporates a button feature that is adapted to release the pawl feature from the striker feature when manually operated.

3. An ice skate as defined in claim 2, wherein the flexible replaceable blade has a groove along the length of its upper surface that mates with a corresponding ridge along the lower surface of the rocker.

4. An ice skate as defined in claim 3, wherein the flexible replaceable blade is adapted to be mounted on a rocker having any of a variety of first curvatures.

5. An ice skate as defined in claim 4, wherein the blade is curved more than 90° at both the front end and the rear end thereof for placement and attachment into the front and rear securing means.

6. An ice skate as defined in claim 3, wherein the blade is curved more than 90° at both the front end and the rear end thereof for placement and attachment into the front and rear securing means.

7. An ice skate as defined in claim 2, wherein the flexible replaceable blade is adapted to be mounted on a rocker having any of a variety of first curvatures.

8. An ice skate as defined in claim 7, wherein the blade is curved more than 90° at both the front end and the rear end thereof for placement and attachment into the front and rear securing means.

9. An ice skate as defined in claim 2, wherein the blade is curved more than 90° at both the front end and the rear end thereof for placement and attachment into the front and rear securing means.

10. An ice skate as defined in claim 1, wherein the flexible replaceable blade has a groove along the length of its upper surface that mates with a corresponding ridge along the lower surface of the rocker.

11. An ice skate as defined in claim 10, wherein the flexible replaceable blade is adapted to be mounted on a rocker having any of a variety of first curvatures.

12. An ice skate as defined in claim 1, wherein the blade is curved more than 90° at both the front end and the rear end thereof for placement and attachment into the front and rear securing means.

13. An ice skate as defined in claim 10, wherein the blade is curved more than 90° at both the front end and the rear end thereof for placement and attachment into the front and rear securing means.

14. An ice skate as defined in claim 1, wherein the flexible replaceable blade is adapted to be mounted on a rocker having any of a variety of first curvatures.

15. An ice skate as defined in claim 14, wherein the blade is curved more than 90° at both the front end and the rear end thereof for placement and attachment into the front and rear securing means.

16. An ice skate as defined in claim 1, wherein the blade is curved more than 90° at both the front end and the rear end thereof for placement and attachment into the front and rear securing means.

17. An ice skate comprising:

a) a holder;

b) the holder having a front end, a rear end and a front securing means;

c) a retention latch adapted to be pivotally mounted to the holder and configured with a pawl feature;

d) a blade system comprising an integral blade and a front retention hook, wherein the integral blade comprises a lower ice-contacting surface;

wherein a rear end of the blade system is adapted to rotate between an open position and a closed position, around a pivot point created when the front retention hook of the blade system engages the front securing means of the holder; and wherein the pawl feature of the retention latch retains the rear end of the blade system in the closed position.

18. An ice skate as defined in claim 17, wherein the pawl feature of the retention latch is biased via a spring into contact with a striker feature incorporated in the rear end of the blade system so the blade system is positively retained in the closed position.

19. An ice skate as defined in claim 18, wherein the retention latch further comprises a retention peg and the spring is a coiled steel wire with a first end and a second end, wherein the first end of the coiled steel wire abuts a surface of the holder and the second end of the coiled steel wire imparts a torque force upon the retention peg to bias the pawl feature against the striker feature.

20. An ice skate as defined in claim 19, wherein the retention latch further comprises a latch releasing feature that is adapted to release the pawl feature from the striker features when manually operated.

21. An ice skate as defined in claim 20, wherein the retention latch is pivotally mounted within the holder and the latch releasing feature comprises a button that is accessible through an aperture in the holder, wherein manually operating the button overcomes the torque force upon the retention peg.

22. An ice skate as defined in claim 17, wherein the holder further comprises a compliant retention surface and the blade system further comprises a biasing surface and wherein while the rear end of the blade system is in the closed position, the biasing surface engages the compliant retention surface generating a compressive load between the holder and the blade system.

23. An ice skate as defined in claim 17, wherein the ice-contacting surface has a first defined curvature.

24. An ice skate as defined in claim 17, wherein the blade system is made of steel selected from the group consisting of heat treatable steel, through-hardened steel that is hardened at least to a "C" scale on the Rockwell scale, and hardenable stainless steel.

25. An ice skate as defined in claim 17, wherein the blade system further comprises a width compensator.

* * * * *